US006302032B1

(12) United States Patent
Ranspach

(10) Patent No.: US 6,302,032 B1
(45) Date of Patent: Oct. 16, 2001

(54) DRAWING HORSE AND MULTI-TASK WORK STATION

(76) Inventor: Ernest J. Ranspach, 434 NE. 8th St., Boca Raton, FL (US) 33432

( * ) Notice: Subject to any disclaimer, the term of this patent is extended or adjusted under 35 U.S.C. 154(b) by 0 days.

(21) Appl. No.: 09/441,816

(22) Filed: Nov. 17, 1999

Related U.S. Application Data

(60) Provisional application No. 60/113,872, filed on Dec. 25, 1998.

(51) Int. Cl.[7] ..... A47B 85/00

(52) U.S. Cl. ..... 108/12; 108/9; 297/156; 312/231; 312/235.4

(58) Field of Search ..... 108/9, 12, 13, 108/42, 50.11; 312/231, 235.4, 235.8; 297/119, 120, 129, 140, 151, 152, 155, 156, 174

(56) References Cited

U.S. PATENT DOCUMENTS

| | | | |
|---|---|---|---|
| D. 61,355 | | 8/1922 | Anderson . |
| D. 140,281 | | 2/1945 | Weller et al. . |
| D. 175,016 | | 6/1955 | Cote . |
| D. 182,061 | | 2/1958 | Cote . |
| D. 183,407 | | 8/1958 | Schaefer . |
| D. 241,324 | | 9/1976 | Wright . |
| D. 260,203 | | 8/1981 | Arnold . |
| D. 275,913 | | 10/1984 | Mulligan . |
| D. 310,603 | | 9/1990 | Keller . |
| D. 335,566 | | 5/1993 | Spriggs et al. . |
| D. 427,790 | | 7/2000 | Gargan . |
| 647,527 | | 4/1900 | Schleuning . |
| 1,582,346 | | 4/1926 | Oster . |
| 1,951,960 | | 3/1934 | Anduaga . |
| 2,245,768 | * | 6/1941 | Ferrary ..... 297/156 |

(List continued on next page.)

OTHER PUBLICATIONS

Artroom Equipment Catalog 1997 illustration of Drawing Horse, Copyright 1997 James Howard Co. (2pp.).
Sax Catalog Circa 1998 Art Horse p.271 (1p.).
High Smith Catalog Circa 1998 Wilson Multimedia Workstation p. 77 (1p.).

*Primary Examiner*—Peter M. Cuomo
*Assistant Examiner*—Jerry D. Anderson
(74) *Attorney, Agent, or Firm*—Robert C. Kain, Jr.; Fleit Kain

(57) ABSTRACT

The drawing horse and multi-task work station is adapted to support a planar board for use by a user. The station includes a generally rectangular, three dimensional central frame structure having a width small enough to be straddled by the user. Planar, rectangular end frame structures are mounted on either end of the central frame structure. The end frame structures include upwardly extending frame portions with a pair of extending end posts thereat. In one embodiment, the work station is provided with a removable drafting board system having pivotal end support elements, supporting the drafting board thereon, mounted to left and right side cross support beams. The cross support beams are removably mounted on the end posts of the end frame structures with end post caps. The caps are at either end of the cross support beams. In another embodiment, the station includes a tray. The bottom side of the tray has a complementary shape to mate with the open frame work of one of the end frame structures such that, when the central frame structure is turned on its end and the end frame structures are vertically aligned (one on the ground plane and the other elevated by the central frame structure), the tray sits atop the open frame work of the raised end frame structure. Other accessories include a drawing board and a vertical support structure for the planar drawing board removably mounted atop the tray, an easel which is an adjustable vertical support structure for painting surfaces removably mounted atop the tray and locked securely to the station, depending legs for each of the end frame structures, and wheels mounted on the terminal ends of the depending legs.

18 Claims, 10 Drawing Sheets

U.S. PATENT DOCUMENTS

| | | | | |
|---|---|---|---|---|
| 2,494,900 | * | 1/1950 | Rosenbaum | 108/13 |
| 2,515,474 | | 7/1950 | Ryder . | |
| 2,530,785 | | 11/1950 | Rocca . | |
| 2,696,415 | | 12/1954 | Himelson . | |
| 2,901,124 | | 8/1959 | Gingher et al. . | |
| 3,361,088 | * | 1/1968 | Hodgkin | 108/12 |
| 3,744,845 | * | 7/1973 | Sooker | 108/12 |
| 4,848,243 | * | 7/1989 | Giordano | 108/9 |
| 4,921,302 | | 5/1990 | Godwin . | |

* cited by examiner

DRAWING HORSE AND MULTI-TASK WORK STATION

This patent application is based upon provisional patent application Ser. No. 60/113,872 filed on Dec. 25, 1998, now pending.

The present invention relates to a drawing horse and multi-task work station which enables the user to prepare art work by drawing or painting, utilize the station as a drafting table (or other type of flat surface or incline surface table) and enable the user to turn the drawing horse frame on end and provide an art stand for drawing, painting, creating sculpture, crafts and displaying art.

BACKGROUND OF THE INVENTION

Current drawing horses are quite crude and usually serve only a single purpose. Typically, the artist straddles the horse between his or her legs and paints or draws on an incline board resting on uprights at one end of the horse.

There is a need, in schools and other institutions and by other artistic individuals, to have a multi-purpose work station which can be quickly converted from an art horse with a drawing board, to a work station with table top, to a drafting table or to a stand-up work station with a support for a planar drawing board and easel for painting surfaces.

OBJECTS OF THE INVENTION

It is an object of the present invention to provide a multi-purpose work station which provides a drawing horse, a drafting table, a horizontal surface table and a stand up work station.

It is another object of the present invention to provide a system which can be easily converted into a drawing table, drafting table, art stand, stand up work station or an art horse.

It is another object of the present invention to provide a stand up work station with open work frame members wherein a tray can be placed on one of the open frame work members thereby supporting and capturing paint, brushes and other articles used in drawing, painting, sculpture and crafts.

SUMMARY OF THE INVENTION

The drawing horse and multi-task work station is adapted to support a planar board for use by a user. The station includes a generally rectangular, three dimensional central frame structure having a width small enough to be straddled by the user. Planar, rectangular end frame structures are mounted on either end of the central frame structure. The end frame structures include upwardly extending frame portions with a pair of extending end posts thereat. In one embodiment, the work station is provided with a removable drafting board system having pivotal end support elements, supporting the drafting board thereon, mounted to left and right side cross support beams. The cross support beams are removably mounted on the end posts of the end frame structures with end post caps. The caps are at either end of the cross support beams. In another embodiment, the station includes a tray. The bottom side of the tray has a complementary shape to mate with the open frame work of one of the end frame structures such that, when the central frame structure is turned on its end and the end frame structures are vertically aligned (one on the ground plane and the other elevated by the central frame structure), the tray sits atop the open frame work of the raised end frame structure. Other accessories include a horizontal design table top with a vertical support structure, a planar drawing board support removably mounted atop the tray, an easel (FIG. 13A and B), which is an adjustable vertical support structure for painting surfaces removably mounted atop the tray and locked securely to the station, a horizontal work surface for sculpture, and crafts that mates with an partially covers the tray, depending legs for each of the end frame structures, and wheels mounted on the terminal ends of the depending legs.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a drawing horse and a multi-task work station.

Figure 1:
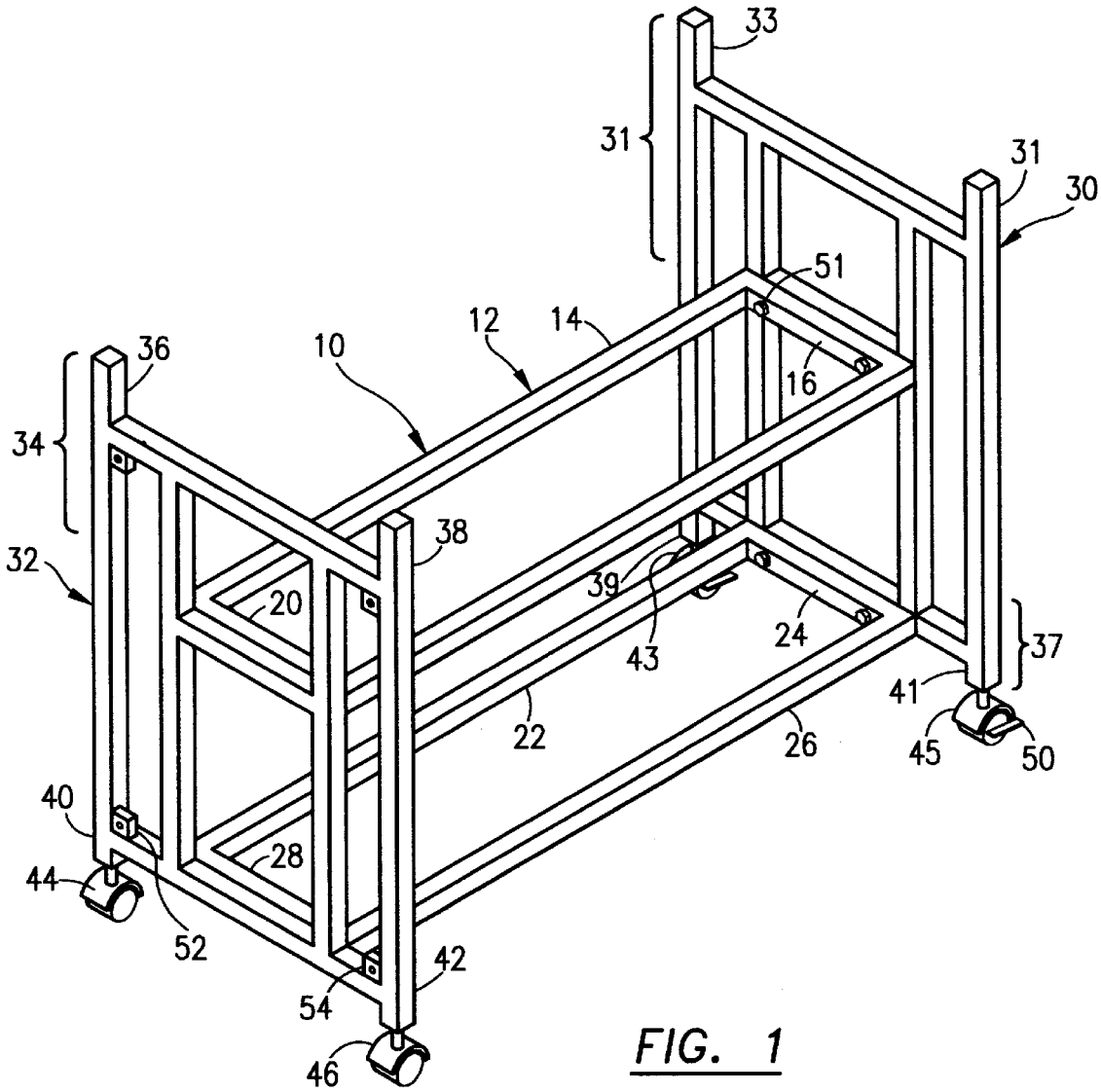
FIG. 1 diagrammatically illustrates a perspective view of the base unit of the drawing horse and multi-task work station in accordance with the principles of the present invention.

FIG. 1 diagrammatically illustrates a perspective view of work station base 10 which includes a central frame structure 12 consisting of top frame members 14, 16, 18 and 20. Central frame structure 12 also consists of a bottom frame comprising frame members 22, 24,26 and 28. Central frame structure 12 is attached at its fore end and its rear end (or aft end) to generally planar and rectangular end frame structures 30, 32. At its aft end, aft end frame structure 32 is attached to central frame structure 12. Fore end frame structure 30 includes an upwardly extending frame portion 31 rising above top frame 14, 16, 18, 20. Further, extending frame portion 31 includes a pair of extending end posts 33, 35 at opposite sides of frame portion 31.

Aft frame end structure 32 also includes upwardly extending frame portion 34 and extending end posts 36, 38.

Fore end frame structure 30 includes, at its lower frame portion 37, depending legs 39, 41. Wheels 43, 45 are mounted at the terminal ends of depending legs 39, 41.

In a similar manner, aft end frame structure 32 includes depending legs 40, 42 and attached wheels 44, 46. In a preferred embodiment, wheels 43, 45, 44 and 46 include a locking or braking mechanism, one of which is locking latch 50 shown on wheel 45.

Central frame structure 12 is easily attached to fore end frame 30 and aft end frame 32 via bolts or screws, one of which is bolt 51 in FIG. 1.

Central frame structure 12 encloses a surface used for seat and shelf made of ¾ inch number nine flat and expanded steel mesh or similar material.

Central frame structure 12 and end frame structures 30, 32 define open frame work. It can be appreciated that different types of open frame work can be provided other than the frame work shown in the figures. The open frame work provides a fairly light weight drawing horse and multi-task work station.

The width of the central frame structure 12, that is, the distance between longitudinal frame member 14 and longitudinal frame member 18, is small enough to be straddled by a user. See the seat in FIGS. 2A and 2B. The length of central frame structure 12 (with the small addition of end frame structures 30, 32) is about 30–40 inches. End frame structures 30, 32 may also include threaded or unthreaded retaining plates in the respective open frame work. Retaining plates 52, 54 are shown mounted in the open frame work of aft frame structure 32 to receive threaded glides that act as levelers when structure is in vertical mode. The glides or guides rotate and enable the user to level horizontal members mounted on the upright stand of FIG. 10.

Figure 2A:
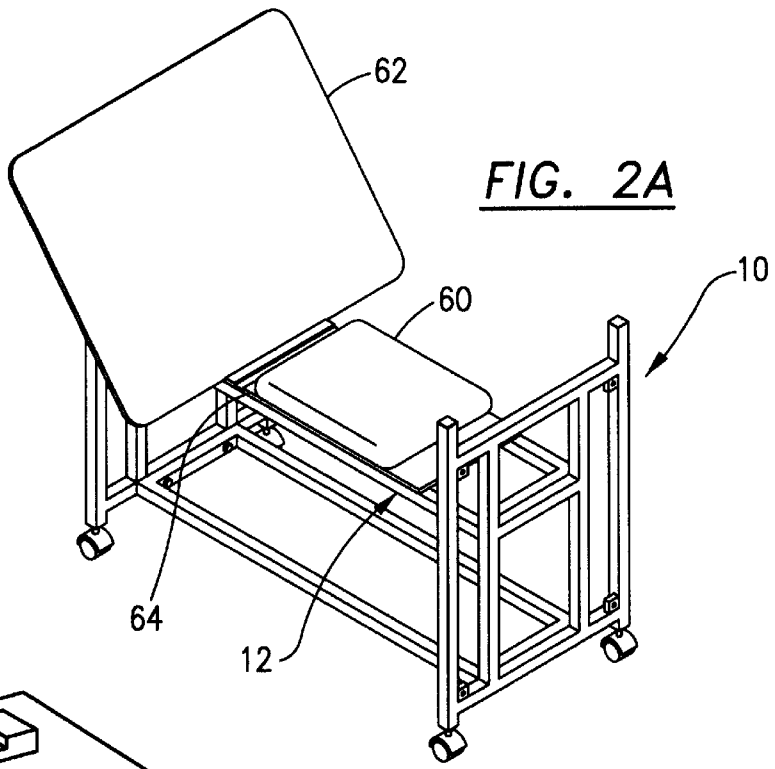
FIGS. 2A and 2B diagrammatically illustrate perspective views of the drawing horse as an art station.
Figure 2B:
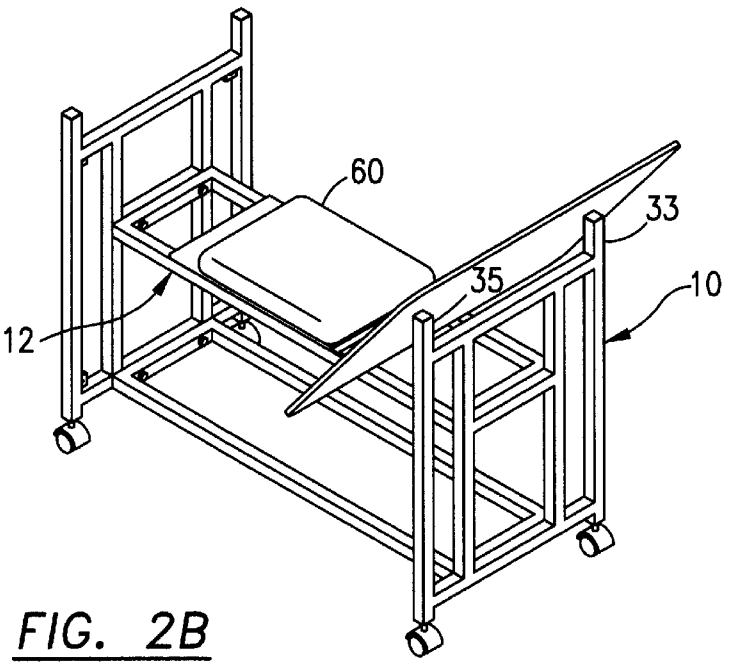
Figure 2C:
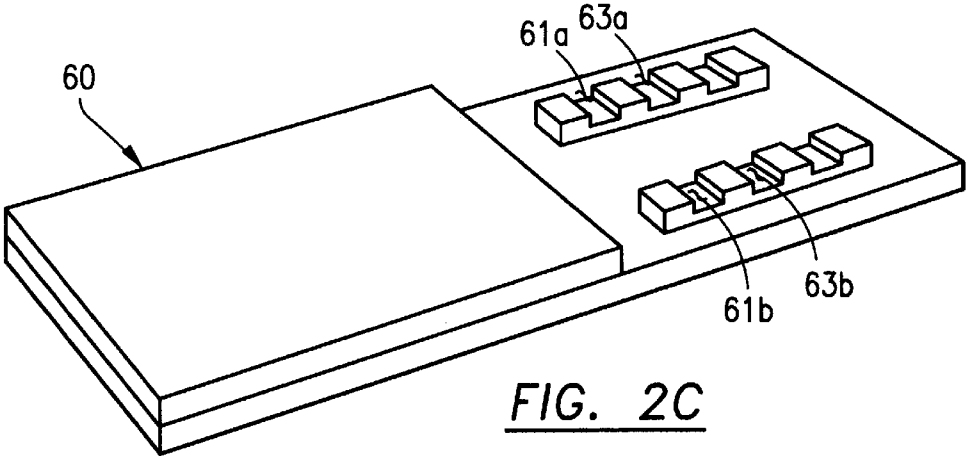
FIG. 2C is a perspective view of the seat.

FIGS. 2A and 2B diagrammatically illustrate work station 10 configured as an art horse. Similar numerals designate similar items throughout the figures. A seat 60 (FIG. 2C) is mounted, either removably or permanently, on top frame 14, 16, 18, 20 of central frame structure 12. An edge of a drawing board 62 is disposed in any set of notches 61*a*, 61*b*, 63*a*, 63*b* etc. and the board leans on end posts 33, 35.

A user, when seated and straddling seat 60, can easily draw, paint or otherwise utilize drawing board 62.

Figure 3:
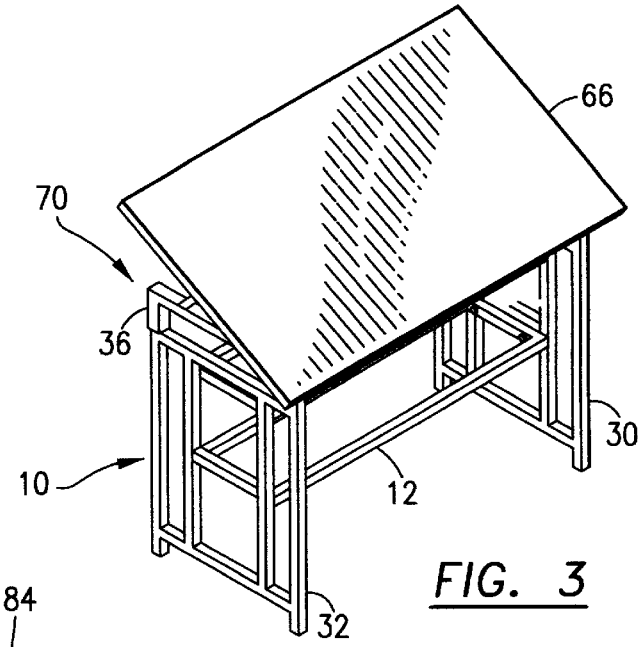
FIG. 3 diagrammatically illustrates a perspective view of the work station configured with a drafting board.
Figure 6:
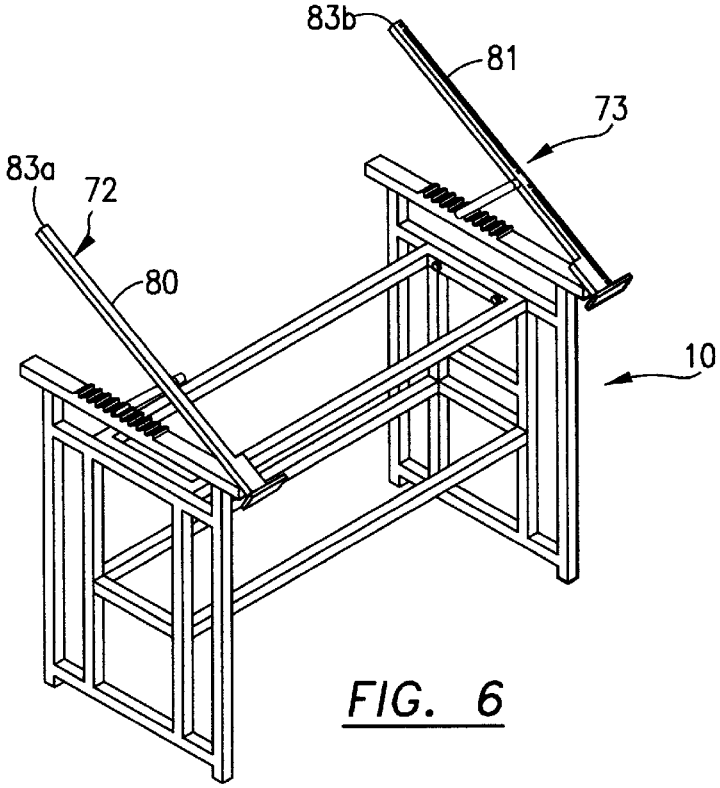
FIG. 6 diagrammatically illustrates the removable drafting board system without a drafting board.

FIG. 3 diagrammatically illustrates work station 10 configured as a drafting board work station. It still includes a central frame structure 12 (with metal mesh), fore end aft end frame structures 30, 32 and extending end posts, one of which is end post 36 extending from the upper portion of aft end frame structure 32. A drafting board 66 is supported on a removable drafting board system 70 described later in connection with FIG. 4. A basic diagram without the board is shown in FIG. 6.

Figure 4:
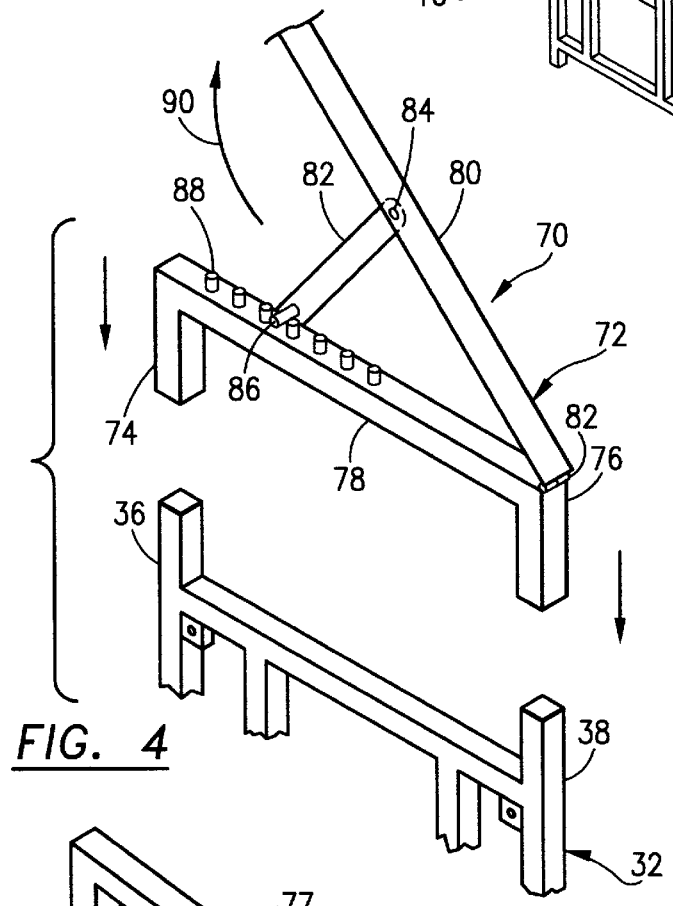
FIG. 4 diagrammatically illustrates the drafting board support member.

FIG. 4 diagrammatically illustrates a perspective view of aft end frame structure 32 and end posts 36, 38. The left hand assembly of removable drafting board system 70 is illustrated in FIG. 4. The left end or left hand assembly is similar to the right hand assembly of drafting board system 70. See FIG. 6. The drafting board assembly includes a drafting board end support member 72 having end post caps 74, 76 adapted to mate with extending end posts 36, 38 of aft end frame structure 32. End post caps 74, 76 are joined together with a cross support beam 78. A hinged support element 80 is pivotally hinged at end 82 to cross support beam 78. A means for providing an upright support to the hinged support element 80 is disposed between hinged support element 80 and cross support beam 78.

Figure 5A:
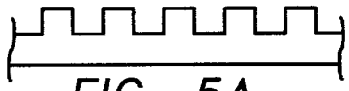
FIGS. 5A and 5B diagrammatically illustrate one of the elevation control systems for the drafting board system.
Figure 5B:
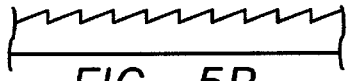

In the illustrated embodiment, this upright support mechanism includes a pivotally mounted arm 82, pivotally mounted at point 84, and a pin or bracket 86 which falls within channels defined by a plurality of pins or upstanding post ends 88 on cross support beam 76. When not in use, pivot arm 82 rotates in direction shown in arrow 90 thereby permitting hinged support element 80 to move downwards and rest atop cross support beam 78. In a collapsed state, drafting board 66 (FIG. 3) is horizontally disposed over the central frame structure 12. In the elevated position shown in FIG. 3, the drafting board is inclined. Pin 88 defining the positional channels can be configured as saw-tooth channels (FIG. 5B) or squared off channels shown in FIG. 5A.

Figure 5C:
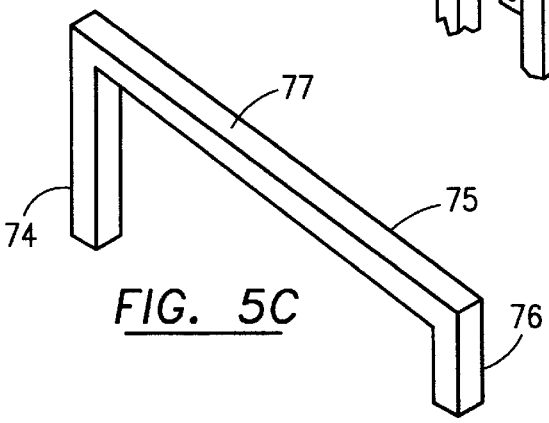
FIG. 5C diagrammatically illustrates a drafting board support member with a fixed angle.

It FIG. 5C diagrammatically illustrates a perspective view of one of the two inclined braces 75 that are fixed to the underside of the drafting table 66 in an alternate embodiment. The end caps 75, 76 are adapted to mate with extending end posts 33, 35 of the fore end frame structure and posts 36, 38 of the aft end frame structure fit with end caps of an opposing inclined brace (not shown).

There are numerous other mechanisms to provide upright support to the hinged support element 80 of the removable drafting board system 70. The following Hinge Support Stop Table describes some of these mechanisms. The term "stop" is used because the mechanism holds the hinged support arm or element 80 in an elevated position above cross support beam 78.

Hinge Support Stop Table

- pivotally mounted stop bar with removable end pin fitted into groove system
- laterally movable angle block (e.g., a triangular block)
- threaded bar (preferably with a pivotal end on the hinged support element)
- free standing upright support beam or bar (preferably with opposing end pieces mating with grooves or channels on cross support beam and hinged support element)

In order to secure drafting board 66 on hinged support element 80 and the right side hinged support element (not shown), the board may include, on its underside, a groove, a pin set or a bar which rests against the terminal end of hinged support element 80. The terminal end is opposite hinge 82.

FIG. 4 diagrammatically illustrates end post caps 74,76 which are fitted onto upstanding end posts 36,38. Caps 74,76 have defined interior spaces that are slightly larger than the outer diameter of upstanding end posts 36, 38. The caps interfit onto the posts.

The height of the removable drafting board system (from the ground plane to cross support beam 78) can be further elevated simply by enlarging the length or height of end post caps 74, 76. For example, end post caps 74, 76 may be 6–12 inches. Accordingly, drafting board 66 can be elevated 6–12 inches above the open frame work of fore end and aft end frame structures 30, 32.

FIG. 6 diagrammatically shows work station 10 and left side and right side drafting board support systems 72, 73. The drafting board is removably mounted on terminal ends 83*a*, 83*b* of hinged support elements 80, 81.

Figure 7:
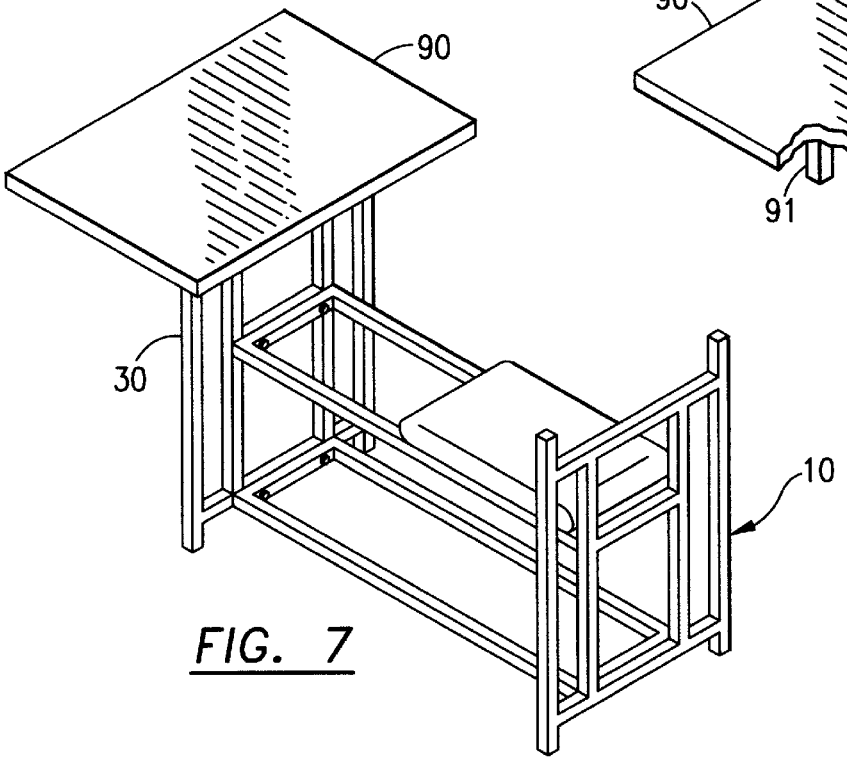
FIG. 7 diagrammatically illustrates a planar design work station.
Figure 8:
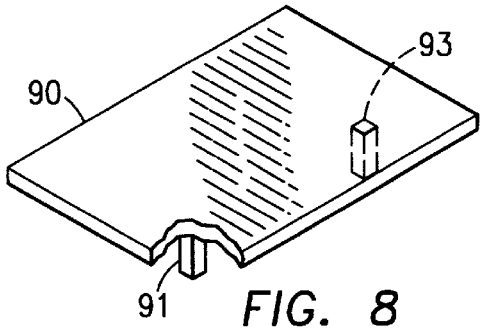
FIG. 8 diagrammatically illustrates a partial, cut-away view of the planar design work top and the depending end post caps for the horizontal planar design work station of FIG. 7.

FIG. 7 diagrammatically illustrates work station 10 having a planar design work table 90 removably attached to fore end frame structure 30. As shown in FIG. 8, drawing board 90 has depending end post caps 91,93 that define interior cavities similar to the interior cavities of end post caps 74, 76 in FIG. 4 utilized in conjunction with drafting board support member 72. As such, design work table 90 can be placed atop fore end frame structure 30 as desired by the user.

Figure 9:
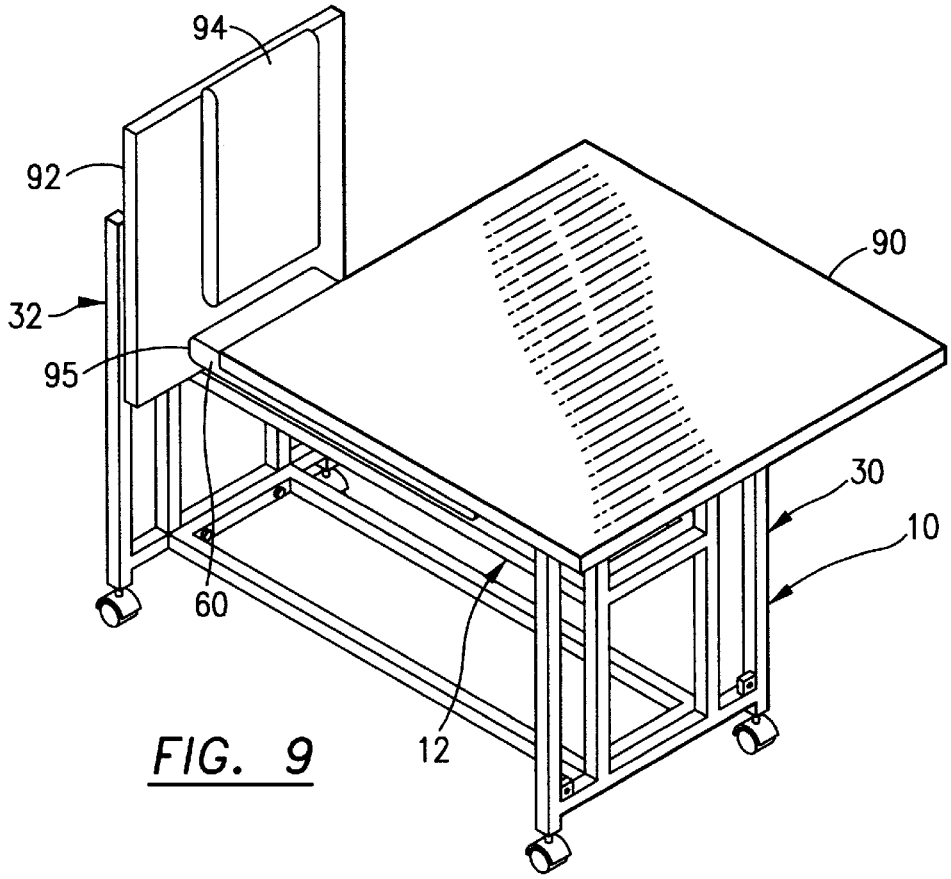
FIG. 9 diagrammatically illustrates the design work station board and a back rest for the user.

FIG. 9 diagrammatically illustrates multi-task work station 10 with design work table 90 removably mounted to the top fore end frame structure 30. Additionally, seat 60 is mounted to central frame structure 12. FIG. 9 also shows a back rest 92 having a back rest cushion 94. Back rest 92 is disposed between the aft end 95 of seat cushion 60 and upwardly extending frame portions of aft end frame structure 32. FIG. 9 also shows wheels on work station 10. In contrast, FIG. 7 shows work station 10 without wheels.

Figure 10:
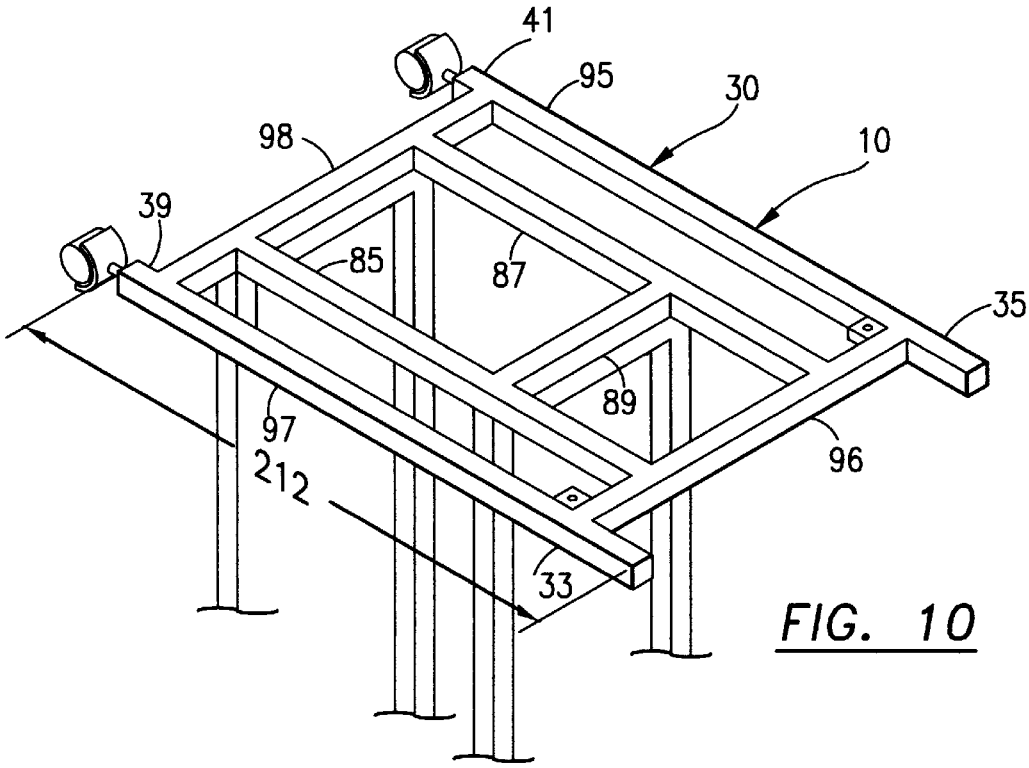
FIG. 10 diagrammatically illustrates the open frame work of one of the end frame structures of the multi-task work station.

FIG. 10 diagrammatically illustrates that work station 10 can be up-ended such that fore end frame structure 30 is elevated above the ground plane. FIG. 10 particularly shows the end frame structure 30 having open frame work consisting of peripheral frame members 95, 96, 97 and 98. Interior frame members 85, 87 and 89 define a plurality of rectangular open work spaces between peripheral frame elements 95, 96, 97 and 98 and the interior frame members 85, 87, 89.

Figure 11:
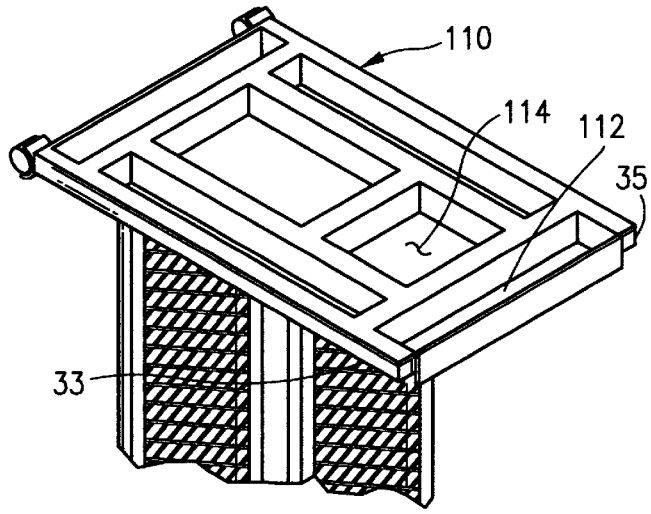
FIG. 11 diagrammatically illustrates a perspective view of a tray mounted on and mated with the open frame work of the end frame structure.

FIG. 11 shows a perspective view of a removable tray 110 which has a bottom which is complementary in shape and is adapted to mate with the open frame work of fore end frame structure 30. As shown in one part of FIG. 11, bottom 112 of tray 110 forms of cavity closely matching the open work formed by end posts 35, 33 and cross piece frame element 96. See the described open work in FIG. 10.

Tray 110 includes a plurality of cavities, one of which is cavity 114, in which the user can place paints, pencils and other drawing materials.

Figure 12A:
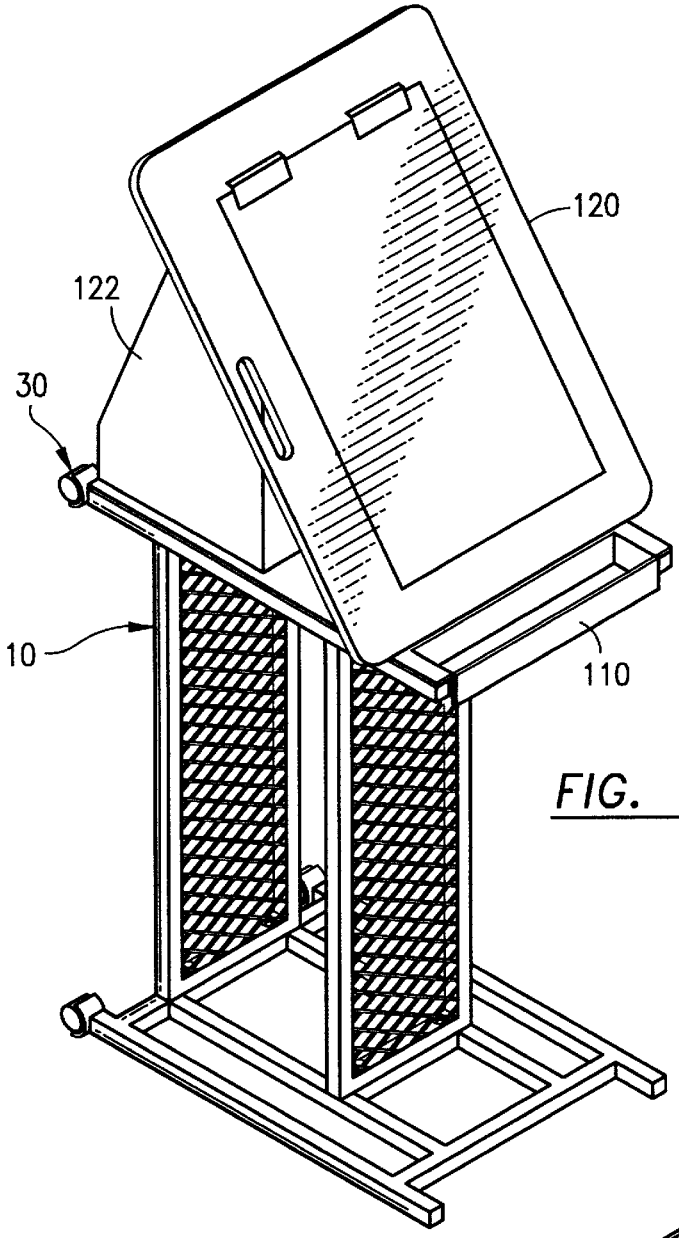
FIGS. 12A and 12B diagrammatically illustrate an art board leaning on a vertical support structure win turn is mounted on the tray and the end frame structure.

FIG. 12A shows a planar drawing board 120 supported by a vertical support mechanism 122 movably mounted atop tray 110.

Figure 14:
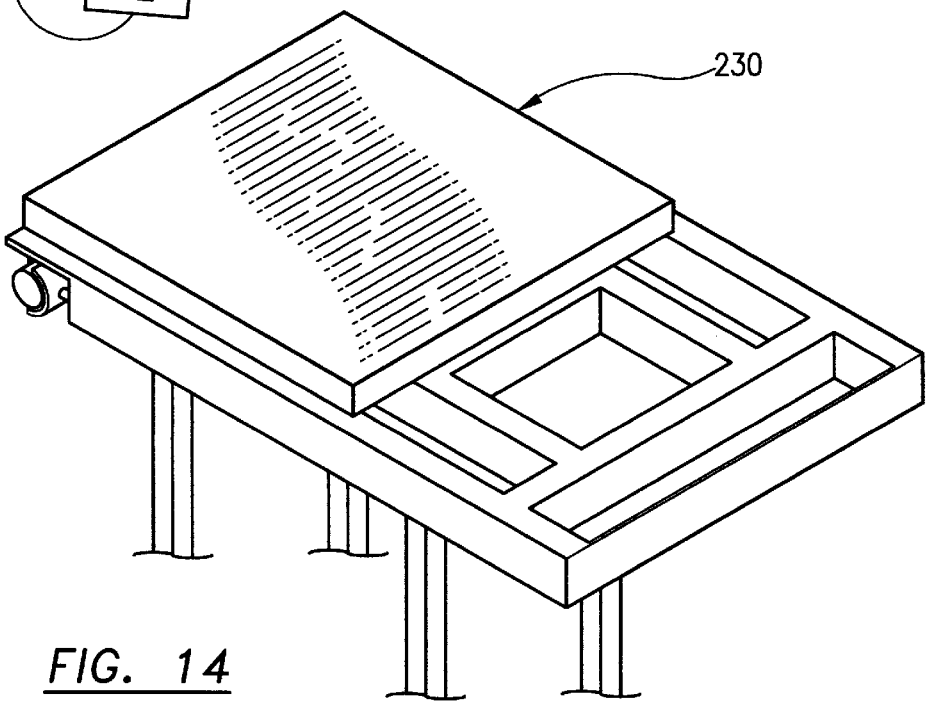
FIG. 14 illustrates a horizontal work surface on the upright end frame.
Figure 15A:
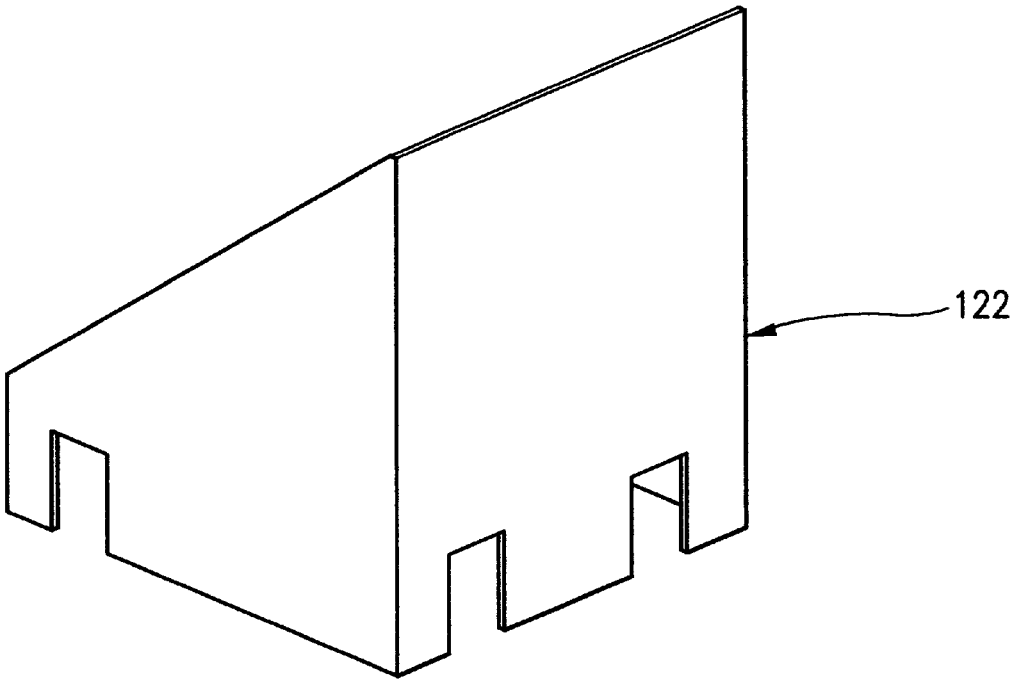
FIGS. 15A and 15B illustrate front and rear perspective views of a vertical support mechanism.
Figure 15B:
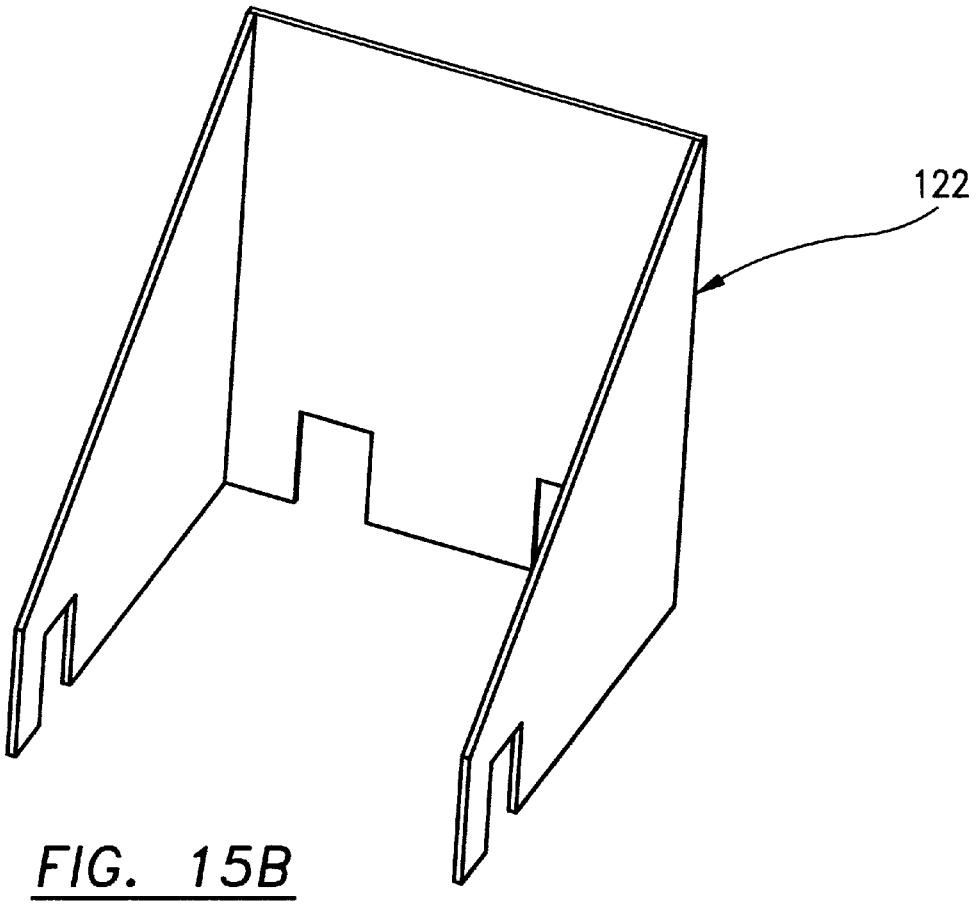

FIGS. 15A and 15B show front and rear perspective views of the vertical support mechanism 122. As illustrated in FIG. 12A, when work station 10 is disposed on its end such that aft end frame structure 32 is on a ground plane and fore end frame structure 30 is vertically disposed above the aft end frame structure, work station 10 becomes a stand up work station. The user can place a flat plate 230 (FIG. 14) atop tray 110 and a sculpture or craft project on a flat plate. The user can place a vertical support mechanism for planar drawing board 120 and paint or draw while standing at work station 10.

Figure 12B:
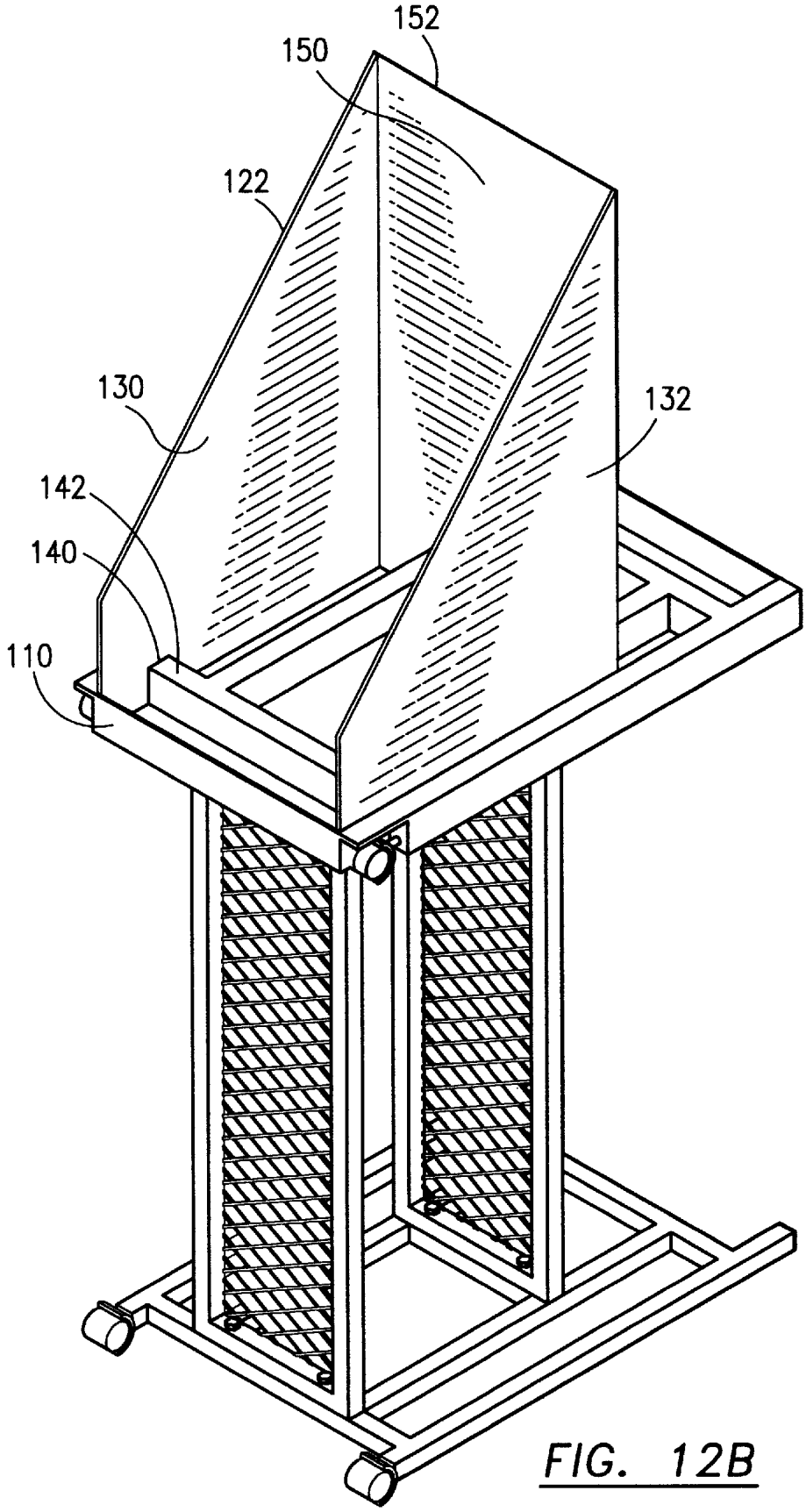

FIG. 12B shows vertical support structure 122 configured as having two triangular plates 130, 132 fitted into various cavities in tray 110. Particularly, triangular support plate 130 includes a cutout 140 complementary to a dividing wall 142 of tray 110. At the front end of triangular supports 130, 132, a vertical support plate 150 is provided. The user places drawing board 120 against the upper edge 152 of vertical support plate 150 while he or she draws, paints or otherwise utilizes planar drawing board 120 as shown in FIG. 12A.

Figure 13A:
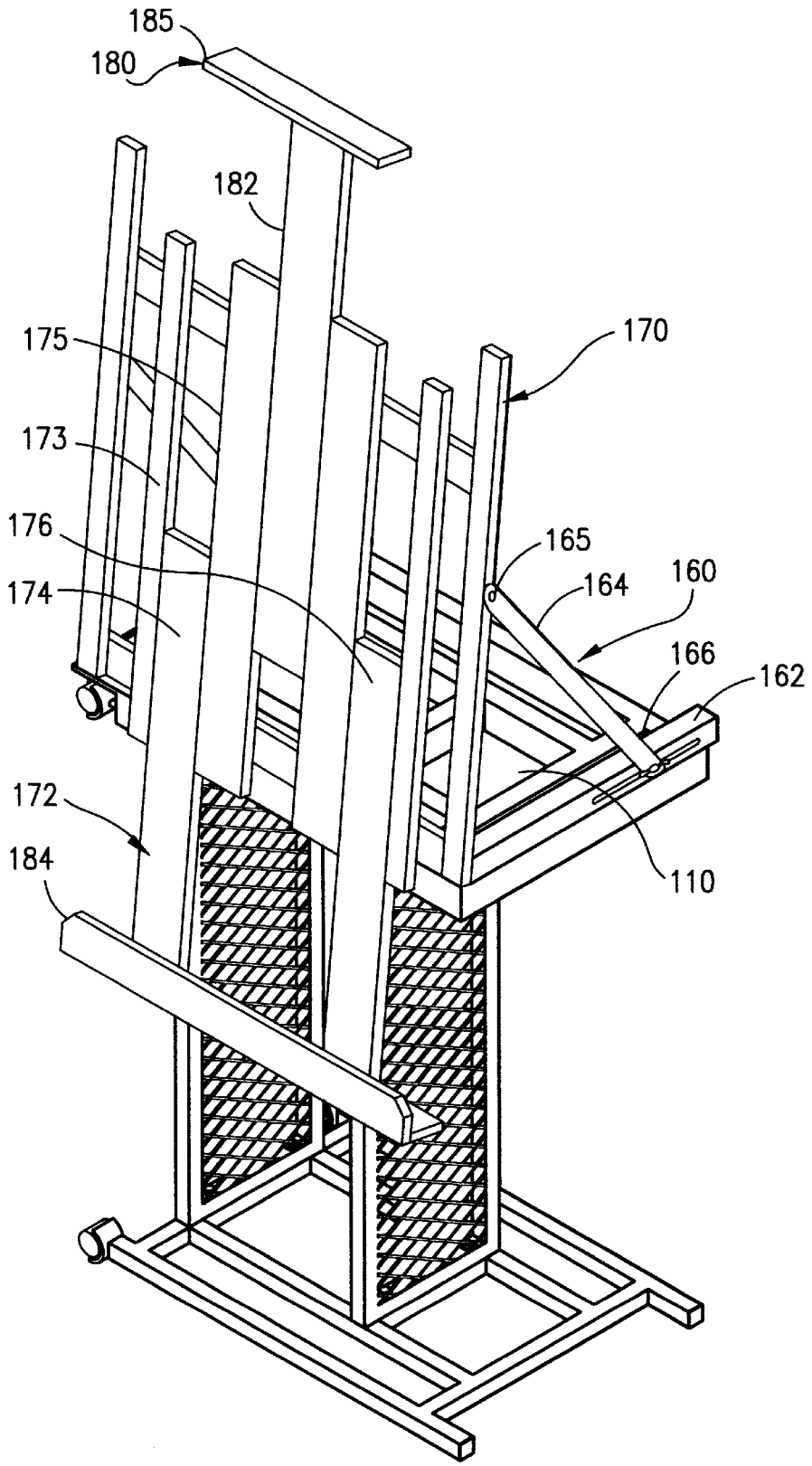
FIGS. 13A and 13B diagrammatically illustrate another vertical support mechanisms mounted on the end frame for the stand-up work station.

FIG. 13A diagrammatically shows a vertical support mechanism commonly known as an easel 160 including lower support frame work 162 that fits or mates, in a complementary manner, on tray 110 and locks to the station. Support system 160 includes an articulating arm 164 (the left side articulating arm being hidden in FIG. 13A) which is pivotally mounted at point 165 to a drawing plate frame 170. At the opposite end of articulating arm 164, a simple locking system 166 is provided to enable the user to adjust the angle of 170. Easel frame 170 includes movable frame element 172 having interlocking legs 174, 176 which move, with the assistance of tongue and groove elements, on the easel frame 170. Two identified groove elements are groove elements 173, 175 which interact with respective tongue elements on movable leg 174. An upper Easel element 180 includes leg 182 which moves in a similar manner in grooves formed in easel 170. Lower and upper moving board frames 172, 180 include ledges or lips 184, 185 in order to capture a canvas or board painting surface placed on the planar frame defining surface of frame system 170. Frame system 170 includes upstanding middle extension 236.

Figure 13B:
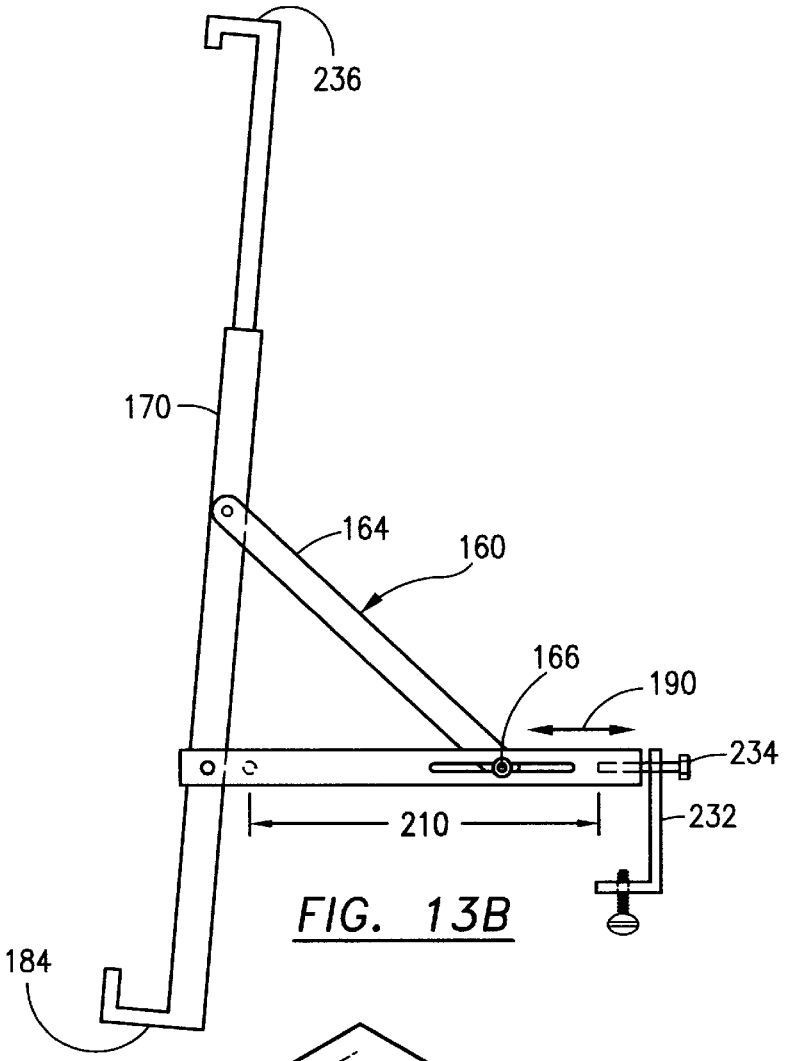

FIG. 13B shows a detailed, diagrammatic view of vertical support mechanism 160. Latch 166 at the terminal end of articulating arm 164 includes a washer and a bolt with wing nut. When the user loosens the wing nut, articulating arm 164 can move in the direction shown by double headed arrow 190. By changing the lateral position of adjustable end 166, the user can adjust the angle of easel support 170 from horizontal when used for water colors, to vertical for oils and acrylics, to a little beyond vertical for use with pastels. On one end, the support mechanism 160 includes a clamp system 232 attached by bolt 234 to the end of the horizontal support member. The clamp enables secure attachment of the support mechanism 160 to the upright stand.

Rather than mount the drawing stand support 160 on tray 110, the support structure, 160 can be sized such that distance 210 is generally equivalent to the outer periphery of the open frame work of the fore end frame structure 30. In another words, distance 210 in FIG. 13B may be generally equivalent to distance 212 of the end frame in FIG. 10. When closed for storage it measures 2'×2'×6" at maximum extension it will support a painting surface larger than 5' in height.

The claims appended hereto are meant to cover modifications and changes within the scope and spirit of the present invention.

What is claimed is:

1. A drawing horse and a multi-task work station for a user comprising:

a generally rectangular, three dimensional central frame structure, said central frame structure having a fore end and an aft end and a top frame and a bottom frame, said central frame structure having a width, spanning said top frame, small enough and adapted to be straddled by said user;

generally planar, rectangular end frame structures mounted on said fore end and said aft end; of said central frame structure, a user's seat disposed on said top frame of said central frame structure;

said fore end and said aft end frame structures each having extending frame portions rising above said top frame of said central frame structure and further having a pair of extending end posts at opposite sides of said extending frame portions;

said fore end frame structure defining an open frame work;

wherein a planar board is adapted to rest between said seat and said extending end posts of said fore end frame structure;

a removable drafting board system having left and right side drafting board support members, each drafting board support member having a pair of end post caps adapted to mate with said pair of extending end posts of said fore and aft end frame structures, each drafting board support member having a cross support beam joining each said pair of end post caps, said drafting board system including left and right side hinged support elements which arce correspondingly pivotally mounted on left and right side cross support beams of said left and right side support members, said drafting board system having left and right side means for providing upright support respectively to said left and right hinged support elements, wherein said planar board is adapted to be disposed on said hinged support elements such that said planar board is adapted to be overlaid atop and vertically spaced apart said top frame of said central frame structure;

a tray having a top side and a bottom side, said bottom side having a complementary shape adapted to mate with said open frame work of said fore end frame structure, said top side of said tray having at least one containment cavity, said tray adapted to be fit atop said fore end frame structure when said central frame structure is vertically disposed with said aft end frame structure placed on a ground plane; and, having at least one containment cavity, said tray adapted to be fit atop said one end frame structure when said central frame structure is vertically disposed with said end frame structure placed on a ground plane;

a planar drawing board and means for supporting said planar drawing board removably mounted atop said one end frame structure when said central frame structure is vertically disposed with said end frame structure placed on a ground plane.

2. A drawing horse and multi-task work station as claimed in claim 1 wherein said end frame structures each include a pair of depending legs, extending below said bottom frame of said central frame structure.

3. A drawing horse and multi-task work station as claimed in claim 2 including respective wheels mounted on terminal ends of said depending legs.

4. A drawing horse and multi-task work station as claimed in claim 1 wherein said central frame structure is an open frame, rectangular box.

5. A drawing horse and multi-task work station as claimed in claim 3 wherein said central frame structure is a rectangular box with a sheet of expanded steel mesh or similar material welded to all four sides of said rectangular box.

6. A drawing horse and a multi-task work station adapted to support a planar board for use by a user comprising:

a generally rectangular, three dimensional central frame structure said central frame structure having a fore end and an aft end and a top frame and a bottom frame, said central frame structure having a width, spanning said top frame, small enough and adapted to be straddled by said user;

generally, rectangular end frame structures respectively mounted on said fore end and said aft end of said central frame structure;

a user's seat disposed on said top frame of said central frame structure;

said end frame structures each having extending frame portions rising above said top frame of said central frame structure and further having a pair of extending end posts at opposite sides of said extending frame portions;

one of said end frame structures defining an open frame work;

and a work surface selected from a group comprising:

a removable drafting board system having left and right side drafting board support members, each of said drafting board support members having a pair of end post caps adapted to mate with said pair or extending end posts of said end frame structures, each drafting board support member having a cross support beam joining each said pair of end post caps, said drafting board system including left and right side hinged support elements which are correspondingly pivotally mounted on left and right side cross support beams of said left and right side support members, said drafting board system having left and right side means for providing upright support respectively to said left and right hinged support elements, and a drafting board adapted to be disposed on said hinged support elements such that said drafting board is overlaid atop and vertically spaced apart said top frame of said central frame structure; and, a tray having a top side and a bottom side, said bottom side having a complementary shape adapted to mate with said open frame work, said top side of said tray having at least one containment cavity, said tray adapted to be fit atop said one end frame structure when said central frame structure is vertically disposed with said end frame structure placed on a ground plane.

7. A drawing horse and multi-task work station as claimed in claim 6 including a planar drawing board and means for supporting said planar drawing board removably mounted atop said end frame structure.

8. A drawing horse and multi-task work station as claimed in claim 6 including a removable horizontally disposed board desk having a pair of end post caps adapted to mate with extending end posts of said frame structure, said board desk end post caps depending from an underside of said board desk.

9. A drawing horse and multi-task work station as claimed in claim 6 wherein said end frame structures each include a pair of depending legs, extending below said bottom frame of said central frame structure.

10. A drawing horse and multi-task work station as claimed in claim 9 including respective wheels mounted on terminal ends of said depending legs.

11. A kit assembly for a drawing horse and a multi-task work station adapted to support a planar board for use by a user comprising:

a generally rectangular, three dimensional central frame structure, said central frame structure having a fore end and an aft end and a top frame and a bottom frame, said central frame structure having a width, spanning said top frame, small enough and adapted to be straddled by said user;

a fore end and an aft end generally planar, rectangular frame structures respectively mounted on said fore end and said aft end of said central frame structure;

a user's seat disposed on said top frame of said central frame structure;

said fore end and said aft end frame structures each having extending frame portions rising above said top frame of said central frame structure and further having a pair of extending end posts at opposite sides of said extending frame portions;

said fore end frame structure defining an open frame work;

wherein a planar board is adapted to rest between said seat and said extending end posts of said fore end frame structure;

a removable drafting board system having left and right side drafting board support members, each drafting board support member having a pair of end post caps adapted to mate with said pair of extending end posts of said fore and aft end frame structures, each drafting board support member having a cross support beam joining each said pair of end post caps, said drafting board system including left and right side hinged support elements which are correspondingly pivotally mounted on left and right side cross support beams of said left and right side support members, said drafting board system having left and right side means for providing upright support respectively to said left and right hinged support elements, wherein said planar board is adapted to be disposed on said hinged support elements such that said planar board is adapted to be overlaid atop and vertically spaced apart said top frame of said cental frame structure;

a tray having a top side and a bottom side, said bottom side having a complementary shape adapted to mate with said open frame work of said fore end frame structure, said top side of said tray having at least one containment cavity, said tray adapted to be fit atop said fore end frame structure when said central frame structure is vertically disposed with said aft end frame structure placed on a ground plane; and, means for supporting said planar board removably mounted atop said fore end frame structure and said open frame work when said central frame structure is vertically disposed with said aft end frame structure placed on a ground plane.

12. A kit assembly drawing horse and multi-task work station as claimed in claim 11 wherein said fore end and said aft end frame structures each include a pair of depending legs, extending below said bottom frame of said central frame structure.

13. A kit assembly drawing horse and multi-task work station as claimed in claim 12 including respective wheels mounted on terminal ends of said depending legs.

14. A kit assembly for a drawing horse and a multi-task work station adapted to support a planar board for use by a user comprising:

a generally rectangular, three dimensional central frame structure, said central frame structure having a fore end and an aft end and a top frame and a bottom frame, said central frame structure having a width, spanning said top frame, small enough and adapted to be straddled by said user;

a fore end and an aft end generally planar, rectangular frame structures respectively mounted on said fore end and said aft end of said central frame structure;

a user's seat disposed on said top frame of said central frame structure;

said fore end and said aft end frame structures each having extending frame portions rising above said top frame of said central frame structure and further having a pair of extending end posts at opposite sides of said extending frame portions;

said fore end frame structure defining an open frame work;

wherein a planar board is adapted to rest between said seat and said extending end posts of said fore end frame structure;

a removable drafting board system having left and right side drafting board support members, each of said drafting board support members having a pair of end post caps adapted to mate with a respective pair of extending end posts of said fore and aft end frame structures, each drafting board support member having a cross support beam joining each said pair of end post caps, said drafting board system including left and right side hinged support elements which are correspondingly pivotally mounted on left and right side cross support seams of said left and right side support members, said drafting board system having left and right side means for providing upright support respectively to said left and right hinged support elements, wherein said planar board is adapted to be disposed on said hinged support elements such that said planar board is adapted to be overlaid atop.

15. A drawing horse and multi-task work station as claimed in claim 14 including a tray having a top side and a bottom side, said bottom side having a complementary shape adapted to mate with said open frame work of said fore end frame structure, said top side of said tray having at least one containment cavity, said tray adapted to be fit atop said fore end frame when said central frame structure is vertically disposed with said aft end frame placed on a ground plane.

16. A drawing horse and multi-task work station as claimed in claim 14 including means for supporting said planar board adapted to be removably mounted atop said fore end frame and said open frame work when said central frame structure is vertically disposed with said aft end frame placed on a ground plane.

17. A drawing horse and multi-task work station as claimed in claim 14 wherein said fore end and said aft end frame structures each include a pair of depending legs, extending below said bottom frame of said central frame structure.

18. A drawing horse and multi-task work station as claimed in claim 17 including respective wheels mounted on terminal ends of said depending legs.

* * * * *